US012137846B2

(12) United States Patent
Manero Lojendio et al.

(10) Patent No.: US 12,137,846 B2
(45) Date of Patent: Nov. 12, 2024

(54) TOILET SEAT

(71) Applicant: IMPROVING MOBILITY DEVELOPMENT SL, Valencia (ES)

(72) Inventors: Ignacio Manero Lojendio, Valencia (ES); Francisco Serrano Parra, Valencia (ES)

(73) Assignee: IMPROVING MOBILITY DEVELOPMENT SL, Valencia (ES)

( * ) Notice: Subject to any disclaimer, the term of this patent is extended or adjusted under 35 U.S.C. 154(b) by 121 days.

(21) Appl. No.: 18/192,302

(22) Filed: Mar. 29, 2023

(65) Prior Publication Data

US 2023/0309762 A1 Oct. 5, 2023

(30) Foreign Application Priority Data

Mar. 30, 2022 (ES) ..... ES202230290

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS

| | | | | |
|---|---|---|---|---|
| 11,304,530 | B1 * | 4/2022 | Lin | A61G 5/1002 |
| 11,717,119 | B2 * | 8/2023 | Van Varick | A47K 11/04 4/483 |
| 2010/0243011 | A1 * | 9/2010 | Lin | A61H 3/00 248/95 |
| 2011/0067739 | A1 * | 3/2011 | Ma | A47C 4/03 211/2 |
| 2011/0138529 | A1 * | 6/2011 | Hsiao | A47K 11/04 4/483 |
| 2011/0219529 | A1 * | 9/2011 | Diamond | A47K 11/04 4/449 |
| 2022/0313033 | A1 * | 10/2022 | Bodman | A47K 11/04 |

* cited by examiner

*Primary Examiner* — Huyen D Le
(74) *Attorney, Agent, or Firm* — Banner & Witcoff, Ltd.

(57) ABSTRACT

Bath seat comprising: a horizontal support; and a support structure for the horizontal support; where the horizontal support is comprised of at least two support elements that form a separation between them that communicates the upper part with the lower part of the horizontal support; where the separation between the elements is of variable length, characterized in that the structure comprises at least two tubular elements, which serve as vertical support for the two support elements, where the union between said elements is made by: at least one clamp element, configured to surround one of the tubular elements of the structure; at least one friction element, configured to contact the other tubular element; where the clamp element is configured to allow the support to slide along the length of the tubular element; and to allow rotation of the support about the tubular element.

13 Claims, 4 Drawing Sheets

TOILET SEAT

TECHNICAL FIELD

The present application belongs to the field of furniture elements, more specifically to the field of furniture elements for bathrooms and showers, and more specifically to furniture elements for bathrooms and showers intended for use by people with reduced or difficult mobility.

BACKGROUND

Currently, the furniture elements used in the domestic environment are widely known, which are intended to facilitate the hygiene and cleaning tasks of people who have reduced mobility, such as the elderly, or the disabled.

Numerous designs of furniture elements can be found on the market that include a horizontal seat on which the user sits, and one or more holes in it, which facilitate access to intimate areas, so that they can be properly cleaned and sanitized.

For example, document WO2012122652 discloses a bathroom seat is that includes an upper part and a pair of drainage holes, where the upper part also includes a channel that extends between the weep holes, entering the fluids into the channel, and directing them to the weep holes.

Document DE102013101455 also belongs to the state of the art, in which a shower stool or shower chair is disclosed that includes a base and a support as a seat, which includes at least one front hole for sanitizing the feet, genitals, and which is characterized in that it additionally comprises a rear sanitary orifice.

Finally, we can also find in the state of the art the document CN105455712, which discloses a folding auxiliary bathroom chair that includes a backrest, a seat, and a handrail, characterized in that the seat includes a seat cushion provided with a central slit, the front part of which is wider than the rear part, so that the user's private parts can be washed comfortably.

As can be seen, there are numerous systems that allow users easy and comfortable access to their private parts. Either by using holes located at strategic points on the seat to facilitate access, or by using a central slot that allows easy access to the entire lower part, allowing it to be cleaned correctly.

However, these systems are made up of fixed solutions, which do not allow the seat to be adapted to the needs of the user, preventing people of different dimensions or sizes of the lower limbs, as well as the private parts that are to be accessed for proceed to cleaning, they can use the same seat.

Additionally, it is necessary to find an adaptable seat to facilitate the work of therapists or assistants who help people with reduced mobility in their hygiene tasks, allowing easy access to their private parts without the need for the user to get up or down. move.

SUMMARY OF THE INVENTION

The toilet seat that the invention proposes is configured, therefore, as a remarkable novelty within its field of application, since according to its implementation and exhaustively, the objectives indicated are satisfactorily achieved, with the characterizing details that do so possible and that conveniently distinguish them IN the final claims that accompany this description.

Specifically, the invention proposes a toilet seat, which comprises a system that allows its dimensions to be adapted to the needs of the user, so that it can be used by different people, regardless of the requirements in terms of dimensions and/or needs of access to private parts that both said user and a supposed assistant may have.

Likewise, and additionally, the invention proposes the use of the toilet seat as a toilet itself, by being able to include a self-supporting bucket in the lower area of the support, so that users can carry out their needs from it, being able to proceed later, as and as previously mentioned, to the cleanliness of their genitals.

To achieve this, the invention proposes a bath seat that will be divided into at least two different parts, configuring a groove or channel in the intermediate area that allows the user access to the intimate areas that he wishes to sanitize, such as the genitals.

In order to achieve the adaptability of the invention, the aforementioned intermediate area may be modified according to the needs of the user, so that they can access their private parts in a simple and ergonomic way.

That is, the present invention proposes a system with a seat divided into at least two different elements, which will configure an intermediate channel that will allow users access to their private parts, where the seat comprises at least one vertical structure as a support element for the seat; and where the distance between the two elements of the seat can be adjustable, modifying, at the same time, the intermediate channel configured by them.

Where the vertical structure comprises at least two tubular elements, such as a metal bar, which will be parallel to each other, and parallel to the horizontal surface on which the seat rests.

Preferably, the movable connection that allows longitudinal movement of at least one of the seat supports will be comprised of at least some clamp-type elements and some friction elements. Where the clamp type elements will be placed on one side of the support, coinciding with one of the tubular elements of the vertical structure; and while the friction elements will be on the opposite side, that is, the side coinciding with the other tubular element of the vertical structure.

The clamp-type elements are configured, then, as an intermediate mechanical connection element between the seat supports, and the vertical structure that serves as a support for them, so that, on the one hand, they will be fixedly attached to the seat support to which they are related; and on the other hand, they will be found surrounding, at least partially, one of the tubular elements of the vertical structure.

With this configuration, both the movement of the support attached to the clamps is allowed, along the length of the tubular element of the vertical structure, as well as its rotation, using the tubular element itself as the axis of rotation, and allowing at least the two defined degrees of freedom.

The clamps, as previously stated, will act in combination with friction elements, configured to directly contact the opposite tubular element to which the clamps are attached. So that, through direct contact, and the application of a sufficient weight on the seat, such as that produced by a user when sitting on it, the immobility of the seat support is achieved, securing it in a certain position until the friction element is released.

Summarizing what has been explained above, the connection between the horizontal support and the vertical structure is made up of one or more clamps, which allow longitudinal displacement and rotation with respect to one of the tubular elements of the structure, and one or more friction elements that act in front of the other tubular element of the structure.

In this way, and in the first place, the freedom of longitudinal movement offered by the clamps allows to vary the separation between the horizontal supports of the seat, in a simple way, without having to use mechanisms, and without limiting the positions to predefined locations, configuring a total regulation.

Secondly, the friction element exerts a resistance to the longitudinal displacement, only when a pressure is exerted on the structure, so that it does not interfere with the variation of the separation between the horizontal supports, acting only when it receives the weight of the user, offering the blocking of the movement.

This system allows an elderly person or person with reduced mobility to carry out their cleaning and hygiene tasks independently, or with the help of a third person, being able to be seated, avoiding possible incidents that may occur, allowing said cleaning to be carried out under a minimum of ergonomics, thanks to the adaptability of the seat to the user's requirements.

Likewise, the present invention may include external elements such as grip handles or a backrest, which help to maximize ergonomics of the invention.

On the other hand, the invention includes the possibility of including a bucket in the lower area of the seat, supported by the seat structure itself through the use of guides, configured so that users can perform their physiological needs without having to go to the toilet, that is, it serves as a substitute for the latter.

This allows it to be located in an area close to, for example, the user's bed, who will not need to go to the toilet or toilet area to meet their needs.

It is also worth noting the use of this seat in conjunction with a common toilet, that is, locating the support in a superior way and coinciding with the bowl of said toilet, so that any user can use it to carry out their needs and proceed to a comfortable cleaning. back of your intimate areas.

Additionally, the seat that is the object of the present invention will include as many elements as are necessary to guarantee its proper functioning, adapting its morphology to the specific needs of each case.

Thus, for example, it may include evacuation holes that facilitate the escape of liquids from the upper part of the seat towards the lower part.

It may also include other elements, such as padding in the contact areas between the user and the seat; or studs and/or tips in the areas in contact with the ground, avoiding possible slipping that may occur during use of the invention.

In this way, the toilet seat and the set of elements described represent an innovation with hitherto unknown structural and constituent characteristics, reasons that, together with its practical utility, provide it with sufficient grounds to obtain the requested privilege of exclusivity.

BRIEF DESCRIPTION OF THE DRAWINGS

To complement the description that is being made and in order to help a better understanding of the characteristics of the invention, a set of drawings is attached as an integral part of said description, where, with an illustrative and non-limiting nature, what has been represented has been following.

LIST OF REFERENCES AND FIGURES

Figure 1:
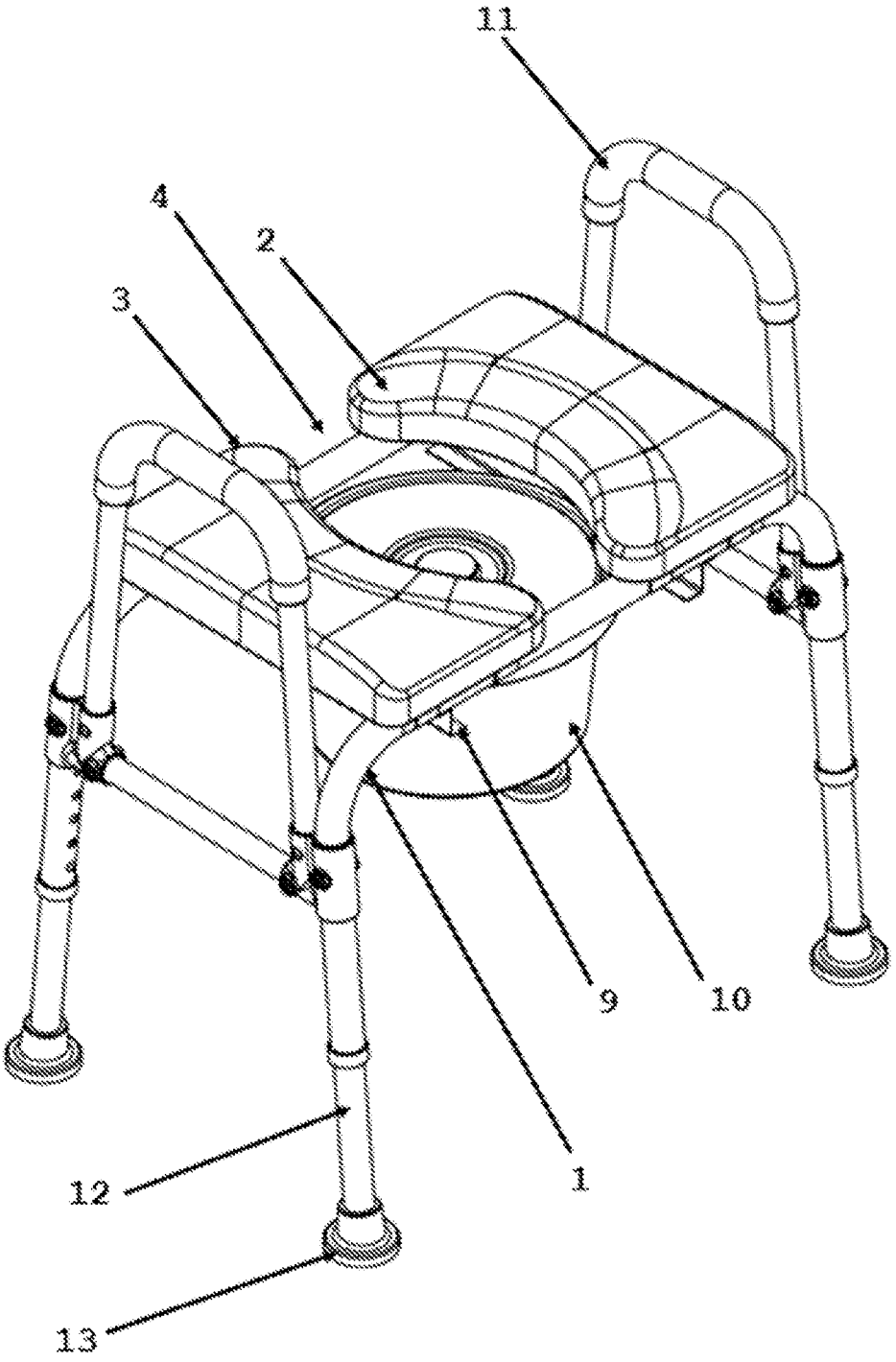
FIG. 1.—Shows a general view of the present invention.
Figure 2:
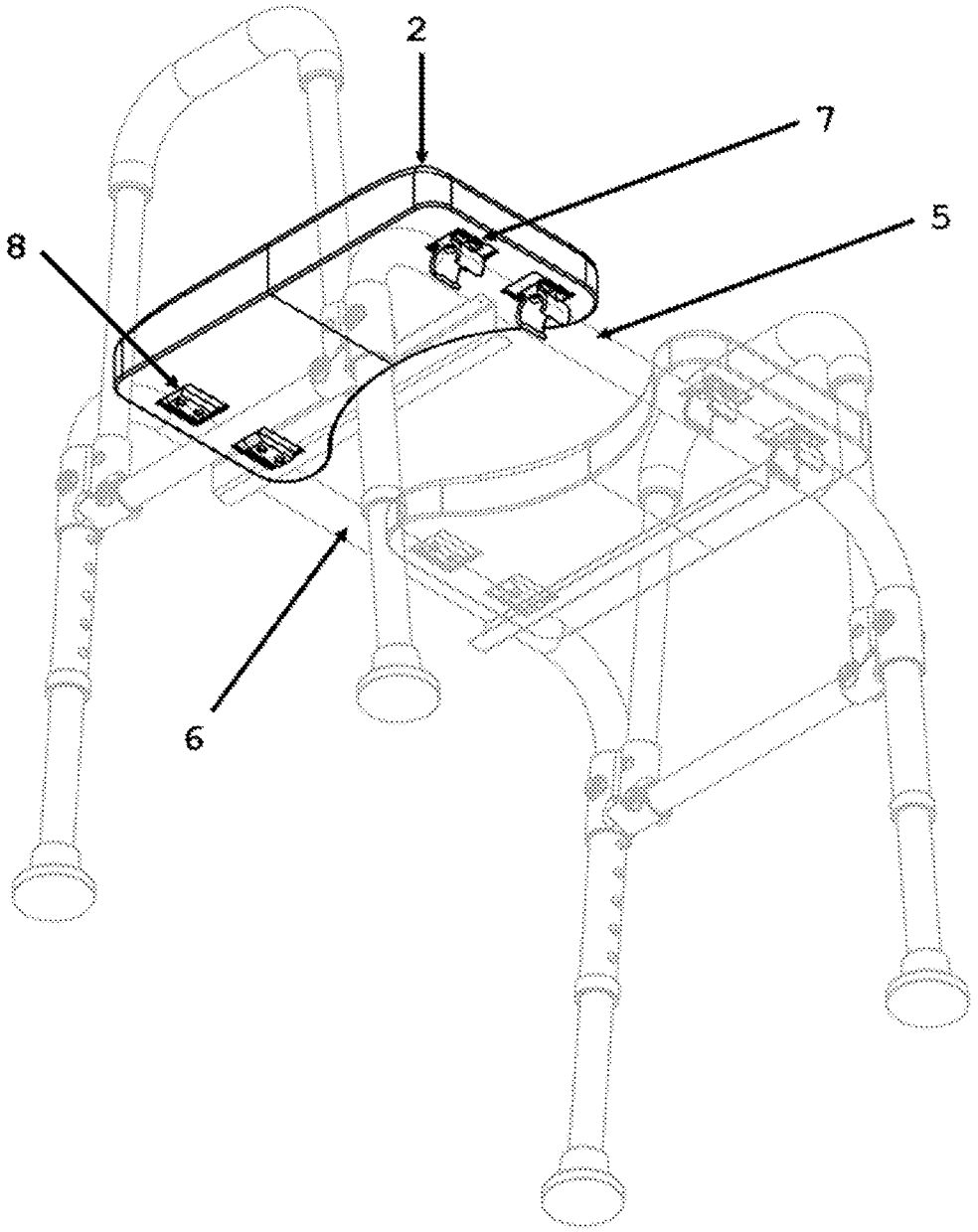
FIG. 2.—Detailed view of the clamp-type elements and friction elements.
Figure 3:
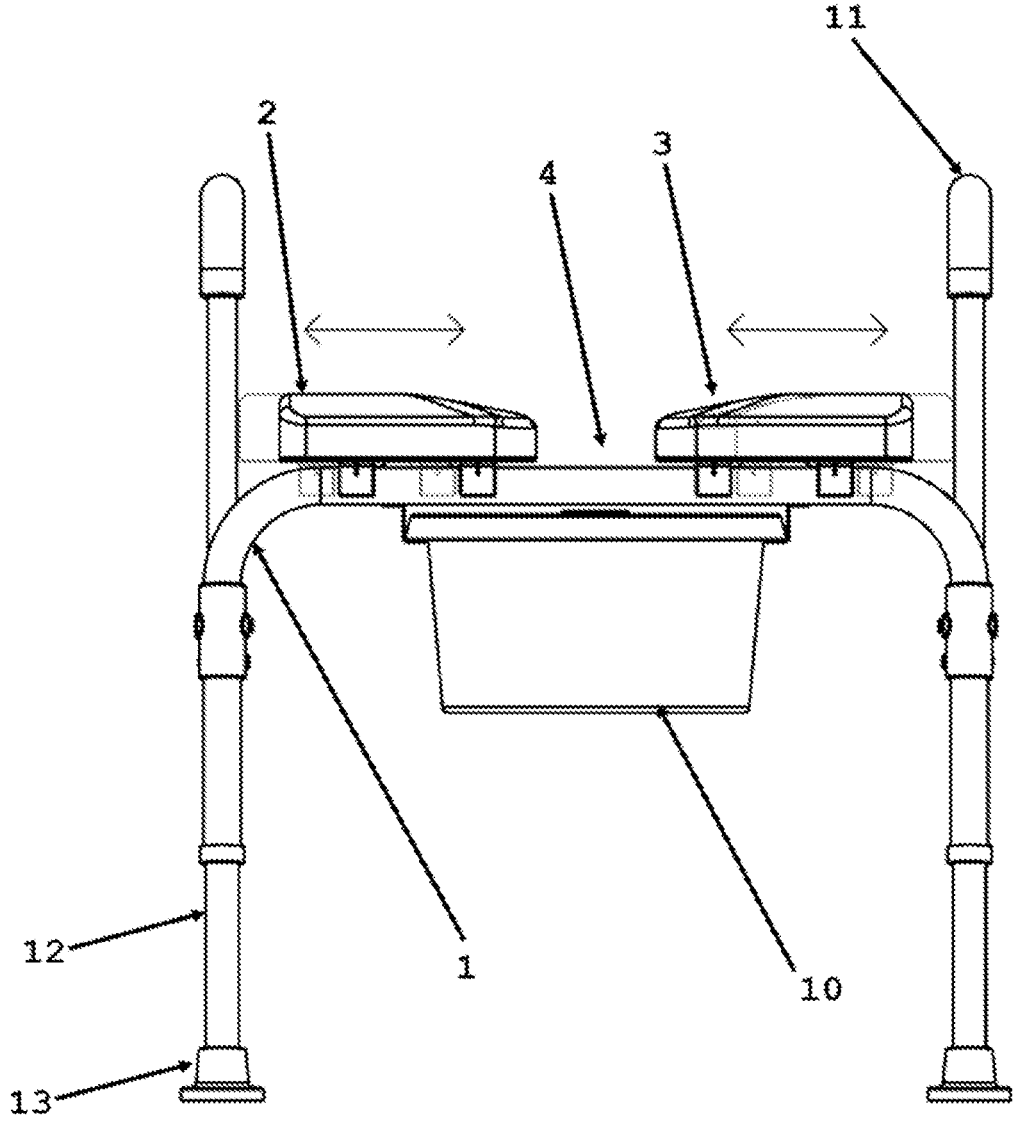
FIG. 3.—Example of embodiment of the invention with movable mobile supports.
Figure 4:
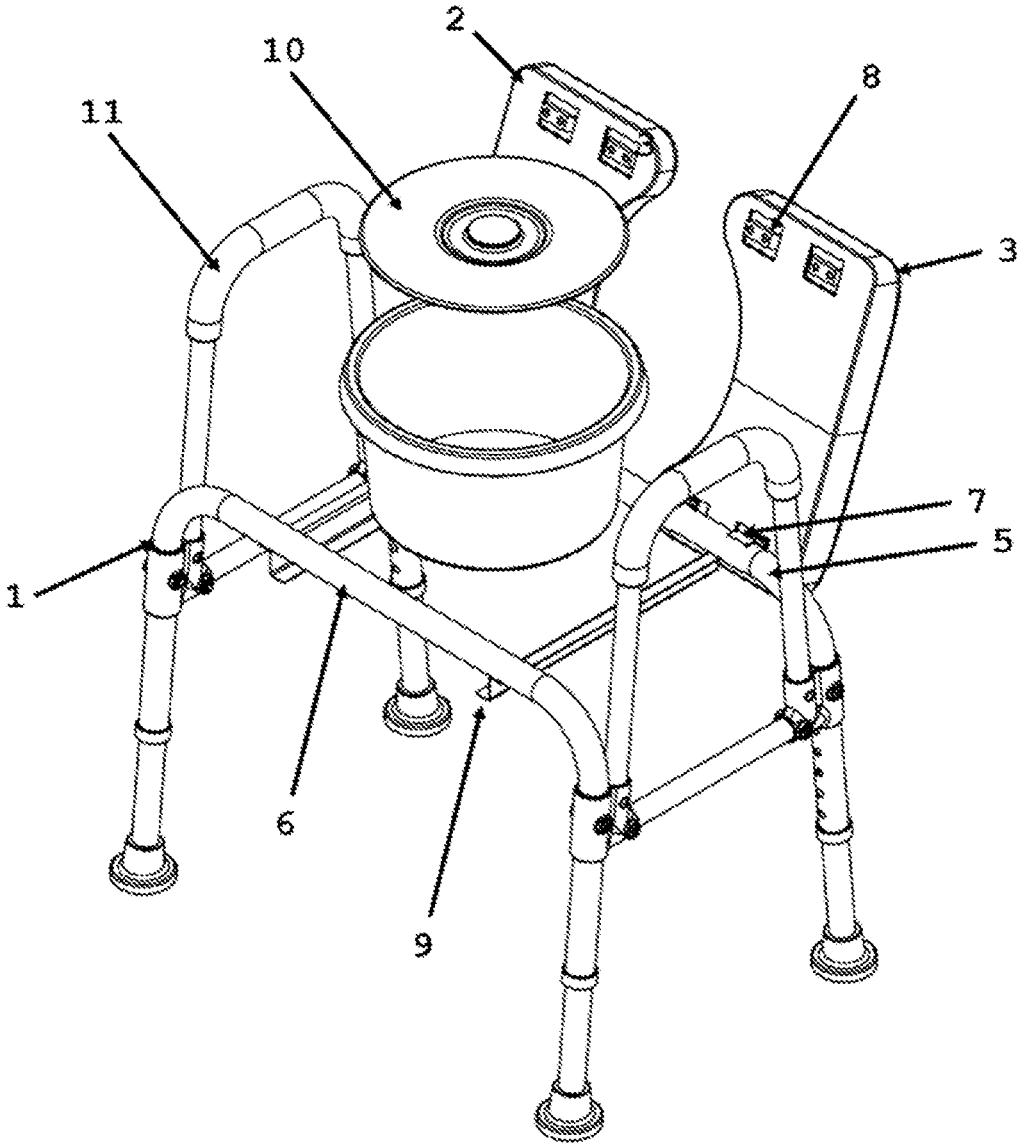
FIG. 4.—Example of embodiment of the invention with a lower bucket.

1. Structure
2. First support element
3. Second support element
4. Separation between support elements
5. First tubular element
6. Second tubular element
7. Clamp-type element
8. Friction element
9. fastening elements
10. Bucket
11. Handle
12. Frame legs
13. Anti-slip elements.

Preferred Embodiment of the Invention

In the following detailed description of the preferred embodiments, reference is made to the accompanying drawings which form a part of this specification, and in which are shown by way of illustration specific preferred embodiments in which the invention may be embodied. These embodiments are described in sufficient detail to enable those skilled in the art to carry out the invention, and it is understood that other embodiments may be used and logical structural, mechanical, electrical, and/or chemical changes may be made without departing from the scope. of the invention. To avoid details not necessary to enable those skilled in the art to carry out the detailed description should therefore not be taken in a limiting sense.

Specifically, the present invention describes a toilet seat comprising a horizontal support, configured as a seat, which rests on a structure 1, configured as a support for the horizontal support.

Where the horizontal support is comprised of at least two support elements 2 and 3, which form a separation space 4 between them, communicating the upper part of the horizontal support with the lower part thereof, being the separation 4 between elements 2 and 3 of variable length, that is, the supports 2 and 3 can move parallel to the ground to widen or reduce the separation 4 between them, adapting to the different conditions of the users, allowing comfortable access to their intimate areas.

This invention is characterized in that structure 1 comprises at least two tubular elements 5 and 6 that serve as vertical support for supports 2 and 3, comprising the union between tubular elements 5 and 6, and supports 2 and 3, clamp-type elements 7 and friction elements 8.

Where the clamp-type elements 7 are configured to surround, at least partially, one of the tubular elements 5 of the structure 1. And where the friction elements 8 are configured to contact the tubular element 6, contrary to that used in the clamp-type elements 7.

The morphology of the clamp-type elements 7 allows the sliding of the supports 2 and 3 along the tubular element 5, so that the movement of expansion/reduction of the separation 4 is achieved.

Additionally, the clamp-type elements 7 also allow rotation of the supports 2 and 3, using the tubular element 5 itself as the axis of rotation.

In this way, and according to the first embodiment of the invention, there are two supports 2 and 3, supported by respective tubular elements 5 and 6, where the connection between said elements is made by using clamp-type elements 7, which allow both the displacement of the supports 2 and 3 along the corresponding tubular element, as well as their rotation, allowing free access to the lower part of the seat object of the present invention.

In a preferred embodiment, the friction element 8, which, as previously mentioned, is configured to contact the tubular element 6, opposite the one where the clamp-type elements 7 are located; comprises at least two operating conditions.

A first operating condition in which the friction element 8 is configured to prevent the supports 2 and 3 from slipping due to the action of the user's weight on the support.

That is to say, when the user is sitting on the supports 2 and 3, the weight force acting on them is transferred to the friction elements 8, which increase the friction force between them and the tubular element 6, preventing the movement of the supports 2 and 3 along the tubular element 6.

And a second operating condition in which the friction element 8, even being in contact with the tubular element 6, is configured to allow the sliding of the supports 2 and 3, since the user is not sitting on them, and friction is not increased, since there is no weight force that maximizes it. Therefore, the translational movement of the supports 2 and 3 is not blocked by the friction element 8.

In this way, it is configured as a system that allows full regulation in terms of the separation between the supports, that is, there is freedom in their longitudinal displacement, without the need to resort to additional mechanisms, or to previously positioned defined.

In a preferred embodiment, and considering the rotation of the supports 2 and 3, facilitated by the clamp-type elements 7 around the tubular element 5; supports 2 and 3 comprise at least two working conditions.

A first condition in which the supports 2 and 3 are in a horizontal position, that is, with the friction elements 8 in contact with the tubular element 6, so that they are supported by at least two support points each one of the supports 2 and 3.

And a second condition in which the supports 2 and 3 are in a vertical open position, with the friction elements 8 separated from the tubular element 6, allowing easy access to the lower area of the seat.

In another preferred embodiment, the seat comprises an additional fastening element 9, configured to vertically support at least one bucket 10, located in the lower part of the supports 2 and 3, so that it coincides with the separation 4, allowing the user to perform their needs, or to clean their most intimate areas, ensuring that the leftovers fall into the bucket 10.

Preferably, the fastening elements 9 will be two parallel rails, which will allow both the vertical support of the bucket 10, as well as its movement along them, facilitating its introduction and/or extraction, both from the front of the seat and from the rear, being able to also move it to the most desired position.

According to this last embodiment, the fastening elements 9 will serve as a rotation stop for the supports 2 and 3, so that physical contact with said fastening elements 9 limits their opening to a certain angle.

Likewise, the supports 2 and 3 in their second operating condition, that is, when they are in a vertical or substantially vertical position, will allow easy access to the bucket, being able to proceed to its extraction in a comfortable and ergonomic way.

In another preferred embodiment, the separation 4 configured by the supports 2 and 3 will not be constant, being able to offer a curvature defined by the inner end of the supports 2 and 3, delimiting at least one front access zone, one rear access zone and an intermediate access area, configuring a greater separation that allows the use of the seat as a toilet, facilitating access to the user's intimate areas.

Likewise, preferably, the surface of at least one of the supports 2 and 3 will be a padded and/or non-slip surface, and will comprise at least two descending upper curvatures. A first curvature on the front and rear faces that release pressure on the user's thighs; and a second curvature in the internal zone, which ensures the correct positioning of the user, both longitudinally when sitting, and transversally.

In another preferred embodiment, the seat comprises a handle 11, which will preferably be located in the structure 1, rising with respect to the seat, and facilitating the incorporation and stability of the user, as well as improving the safety of the same during the maneuvers to perform.

Finally, and in other preferred embodiments, the seat may include additional accessory elements, such as adjusting the height of the horizontal support, or the use of anti-slip elements 13 at the lower end of the legs 12.

The industrial application of the present invention is clear and it seems evident from the description made, since it allows obtaining a seat that is fully adaptable to the dimensions of the user, allowing both the user and a possible assistant to perform hygiene tasks in a manner ergonomic, and without understanding unnecessary risks by preventing you from having to move or get up during the performance of such tasks.

Having sufficiently described the nature of the present invention, as well as the way of putting it into practice, it is not considered necessary to make its explanation more extensive so that any expert in the field understands its scope and the advantages derived from it, stating that, Within its essentiality, it may be put into practice in other embodiments that differ in detail from the one indicated by way of example, and which will also be covered by the protection that is sought provided that its fundamental principle is not altered, changed, or modified.

The invention claimed is:

1. A toilet seat comprising at least: a horizontal support configured as a seat; and a structure (1) configured as a support for the horizontal support; where the horizontal support is comprised of at least two support elements (2, 3) that form a separation (4) between them that communicates the upper part of the horizontal support with the lower part of the horizontal support; where the separation (4) between the support elements (2, 3) is of a variable length, characterized in that the structure (1) comprises at least two tubular elements (5, 6), which serve as vertical support for the two support elements (2,3), where a union between the tubular elements (5,6) and the support elements (2,3) is made by:

at least one clamp-type element (7), configured to surround, at least partially, one of the tubular elements (5) of the structure (1);

at least one friction element (8), configured to contact, at least partially, with the tubular element (6) contrary to the one where the clamp-type element (7) is located;

where the clamp-type element (7) is configured to allow the support elements (2,3) to slide along the length of the tubular element (5);

where the clamp type element (7) is configured to allow the rotation of the support elements (2,3) around the tubular element (5).

2. The toilet seat according to claim 1, characterized in that the friction element (8) comprises at least two operating conditions:

a first operating condition in which the friction element (8) is configured to prevent the support (2,3) from sliding against the action of the user's weight on the support (2,3);

and a second operating condition in which the friction element (8) is configured to allow the support (2,3) to slide against a release of vertical forces on the support (2,3).

3. The toilet seat according to claim 1, characterized in that the supports (2,3) comprise two operating conditions, derived from the rotation of the clamp-type elements (7) around the tubular element (5):

a first operating condition in which the supports (2,3) are in a horizontal position, with the friction elements (8) in contact with the tubular element (6);

and a second operating condition in which the supports (2,3) are in a vertical position, or substantially vertical, and with the friction elements (8) without contact with the tubular element (6).

4. The toilet seat according to claim 3, characterized in that the second operating condition of the supports (2,3) is configured to allow access to the bucket (10).

5. The toilet seat according to claim 1, characterized in that it comprises at least one support element (9), configured to vertically support at least one bucket (10), located in the lower part of the supports (2,3), coinciding with the separation (4).

6. The toilet seat according to claim 5, characterized in that the support elements (9) are at least two rails, configured to support the bucket (10) horizontally and allow its horizontal displacement and/or insertion and/or extraction.

7. The toilet seat according to claim 1, characterized in that the spacing (4) is not constant, being configured according to a curvature defined by the inner end of at least one of the supports (2, 3).

8. The toilet seat according to claim 1, characterized in that the height of the horizontal support is adjustable.

9. The toilet seat according to claim 1, characterized in that it comprises at least one handle (11).

10. The toilet seat according to the claim 9, characterized in that the handle (11) is located in the structure (1).

11. The toilet seat according to claim 1, characterized in that the surface of at least one of the supports (2, 3) is a padded surface and/or a non-slip surface.

12. The toilet seat according to claim 1, characterized in that the support surface of the supports (2,3) is not constant, and comprises at least two downward curves:

a first curve on the front and/or rear face of the supports (2,3);

and a second curve in the internal zone of the supports (2,3).

13. The toilet seat according to claim 1, characterized in that the legs (12) comprise anti-slip elements (13) at their lower end.

* * * * *